United States Patent [19]

Iguchi et al.

[11] Patent Number: 4,710,455

[45] Date of Patent: Dec. 1, 1987

[54] NOVEL SILVER HALIDE CRYSTAL AND PROCESS FOR PRODUCTION OF SAME

[75] Inventors: Keisuke Iguchi; Seigo Ebato, both of Nagaokakyo, Japan

[73] Assignee: Mitsubishi Paper Mills, Ltd., Tokyo, Japan

[21] Appl. No.: 847,315

[22] Filed: Apr. 2, 1986

[30] Foreign Application Priority Data

Apr. 8, 1985 [JP] Japan ..... 60-75042

[51] Int. Cl.[4] ..... G03C 1/02

[52] U.S. Cl. ..... 430/567; 423/489; 423/491; 430/564; 430/569; 430/581

[58] Field of Search ..... 430/567, 569, 564, 581; 423/489, 491

[56] References Cited

U.S. PATENT DOCUMENTS 4,356,257 10/1982 Gerber ..... 430/567 X
4,359,525 11/1982 Gerber ..... 430/567
4,359,526 11/1982 Walworth ..... 430/567 X
4,451,560 5/1984 Gerber et al. ..... 430/567
4,496,652 1/1985 Haugh et al. ..... 430/567 X

FOREIGN PATENT DOCUMENTS 2038792 7/1980 United Kingdom .

*Primary Examiner*—John E. Kittle
*Assistant Examiner*—Mukund J. Shah
*Attorney, Agent, or Firm*—Cushman, Darby & Cushman

[57] ABSTRACT

Disclosed is silver halide cubic crystal having a depression on each face thereof and/or a hollow portion formed by joining of the depression with other depressions. This crystal may be produced by precipitating first monodisperse cubic type silver halide crystals and then precipitating second silver halide having a lower solubility than the first silver halide crystals by controlled doublejet precipitation method to dissolve the first silver halide crystals. There are also disclosed a silver halide photographic emulsion comprising such silver halide crystal and a silver halide photographic high-sensitive material containing said silver halide to which a spectral sensitizing dye is adsorbed.

14 Claims, 3 Drawing Figures

NOVEL SILVER HALIDE CRYSTAL AND PROCESS FOR PRODUCTION OF SAME

BACKGROUND OF THE INVENTION

This invention relates to a novel silver halide crystal, application of a spectral sensitizing dye to said silver halide crystal, a process for preparation of said silver halide crystal and a silver halide photographic light-sensitive material.

Monodisperse silver halide crystals of ordinary shape useful in photography can be produced by the technique called the controlled double-jet precipitation which comprises introducing separate flows of an aqueous solution of a water soluble silver salt and an aqueous solution of a water soluble salt of an alkali metal halide into a gelatin solution under stirring, the process being controlled so as to adjust the shape of the produced silver halide crystal.

Core-shell structure of silver halide grains is reported in many literatures. Typically, the whole surface of the core is covered with one or more layers or "shells" of different silver halides.

It has been known for a long time to change the ratio of the halides and to use both the sensitized and unsensitized core-shell emulsions.

Furthermore, epitaxial mixed silver halide crystals possessing the radiation sensitivity of silver iodide and rapid developability of silver chloride in combination are disclosed in Japanese Patent Unexamined Publication No. 103725/78 and mixed silver halide cubic crystals having different silver halide composition in corner and body portions are disclosed in Japanese Patent Examined Publication No. 124139/80. However, the specific crystal of this invention has not been disclosed in any literatures.

For not only the crystals, but also photographic light-sensitive materials, there are strong demands for enhancement of sensitivity, contrast, etc. to improve the performance thereof. Moreover, development of light-sensitive materials of low silver content has also been strongly required for saving of resource of expensive silver. In order to meet these demands, it is essentially necessary to increase the sensitivity of silver halide photographic light-sensitive materials and this is the most important task for photographic industry.

As is well known, the inherent spectral sensitivity of wavelength region of silver halide per se is limited to short wavelength region of ultraviolet radiation or blue light. Sensitivity in such region can be increased by so-called chemical sensitization, but the wavelength region of sensitivity can hardly be changed. As methods for increasing sensitivity by chemical sensitization there are known sulfur sensitization, noble metal sensitization (for example, gold, palladium, platinum, iridium and selenium sensitizations), reduction sensitization, etc. and combinations thereof.

Extension of wavelength region of spectral sensitivity is accomplished by addition of sensitizing dyes to emulsions and this is known as spectral sensitization. It is known to use spectral sensitizing dyes such as cyanine dyes, e.g., nonmethine dyes, monomethine dyes, dimethine dyes and trimethine dyes alone or in combination (e.g., supersensitization) as spectral sensitizers.

These methods are disclosed in U.S. Pat. Nos. 2,688,545, 2,912,329, 3,397,060, 3,615,635, 3,628,964 and 3,672,898, British Pat. Nos. 1195302, 1242588 and 1293862, German Patent Publication Nos. (OLS) 2030326 and 2121780 and Japanese Patent Examined Publication Nos. 4936/68 and 14030/69.

Spectral sensitization is interpreted by the relative positional relation of energy levels of valence band and conduction band of silver halide crystal with molecular energy level of dye. This is explained in detail in "Photographic Science and Engineering" Vol. 18, pages 49–53, 175–178 and 475–485 (1974) and Vol. 24, pages 138–143 (1980).

However, from the practical viewpoint of spectrial sensitization effect, it is known that the spectral sensitizing effect is influenced by adsorption state of dye to the surface of silver halide crystal and further by chemical sensitizing effect and thus it is the important tasks of spectral sensitization technique for increasing the sensitivity of silver halide photographic light-sensitive materials to bring these requirements under optimum conditions.

SUMMARY OF THE INVENTION

It is an object of this invention to provide a novel silver halide crystal having such structure as affording desired photographic characteristics.

Another object of this invention is to provide a process for producing a photographic emulsion containing said novel silver halide crystal.

Still another object of this invention is to provide photographic materials having excellent photographic characteristics with said novel silver halide crystal.

Further object of this invention is to provide silver halide photographic light-sensitive materials having excellent spectral sensitivity.

DETAILED DESCRIPTION OF THE INVENTION

The novel silver halide crystal of this invention is a cubic crystal and each face of the crystal has a depression, which is preferably deep and joins with other depressions to form a hollow portion.

Figure 2:
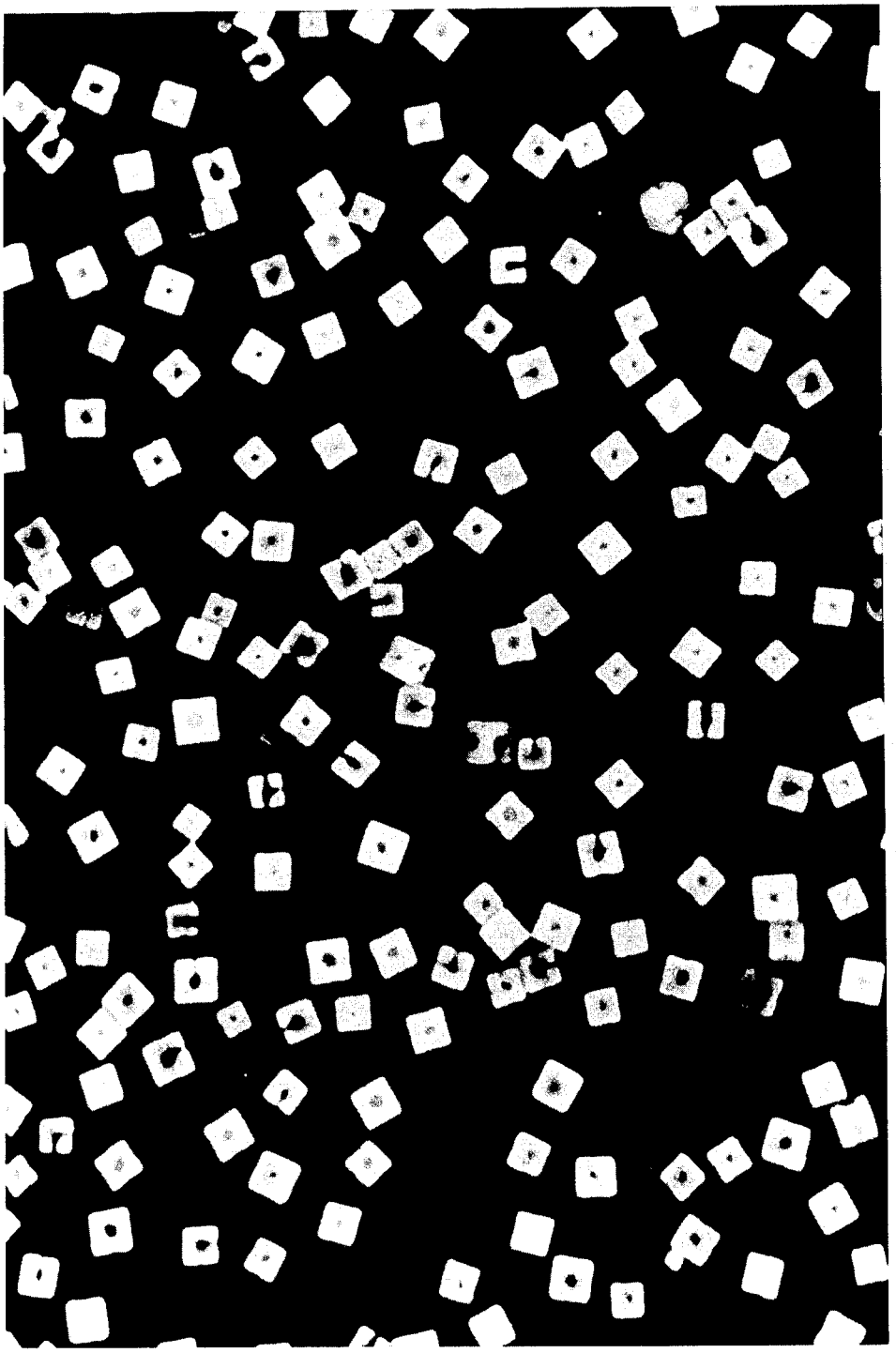
FIG. 2 is an electron photomicrograph (×20000) of the silver halide crystal of this invention produced in Example 1.
Figure 3:
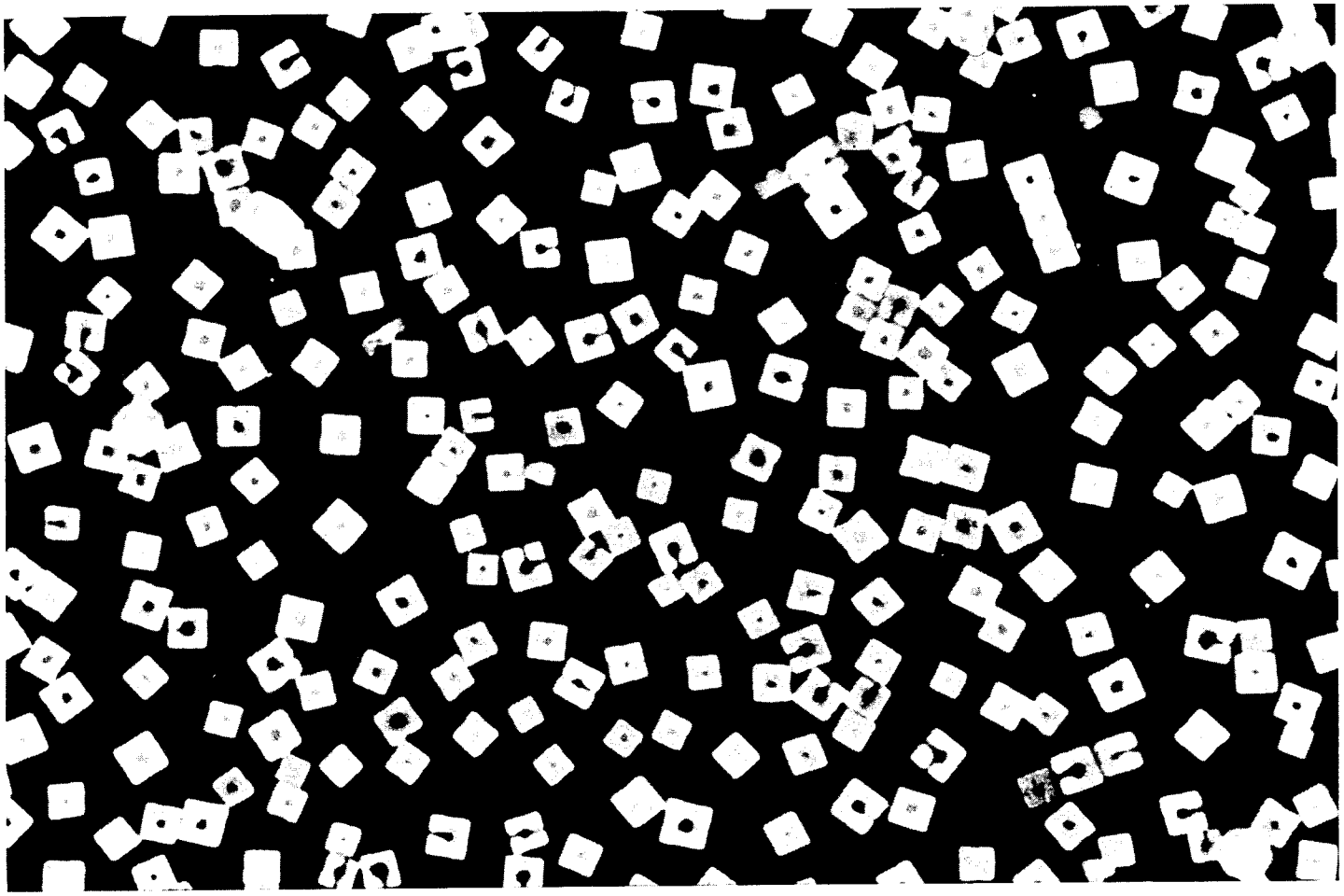
FIG. 3 is an electron photomicrograph (×20000) of the silver halide crystal of this invention produced in Example 2.

The appended FIG. 2 and FIG. 3 are electron micrographs of the silver halide crystals of this invention, from which it will be seen that they are cubic crystals having a depression in each face thereof (indicated by middle tone) and a hollow (indicated by the highest density) in each face thereof and FIG. 3 includes more crystals having the hollow portion than FIG. 2.

The silver halide crystals of this invention have higher sensitivity than the conventional cubic silver halide crystals having the same grain size and halogen composition.

The silver halide crystals of this invention are considered to be obtained by introducing, under certain conditions, into a first original silver halide crystal having a higher solubility an aqueous solution of a halide and an aqueous solution of silver which produce a second sliver halide having lower solubility than the first crystal, resulting in dissolution of the first silver halide crystals and production of the second silver halide.

That is, it is supposed that the second silver halide begins to grow at eight corners of the first silver halide crystals and the growth proceeds with dissolution of the first silver halide crystals to produce depressions and further proceeds to produce hollows.

It will be recognized from FIG. 2 and FIG. 3 that although it depends on preparation conditions, the growth rate is different between the crystals or between the faces (or corners) of each crystal and so there are present crystals different in shape.

Figure 1:
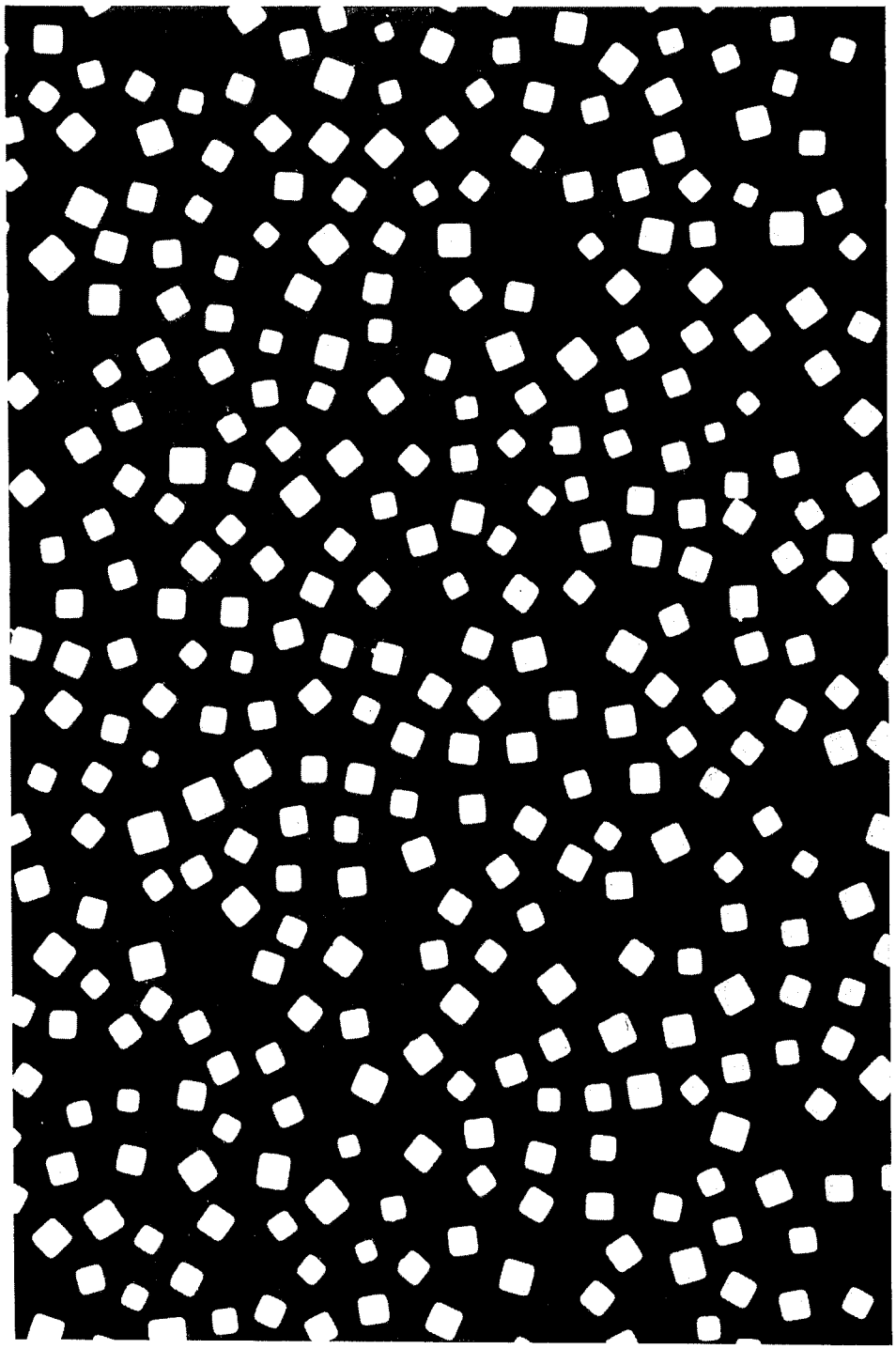
FIG. 1 is an electron photomicrograph (×20000) of the first original silver halide (silver chloride) crystal produced in referential example given hereinafter.

The silver halide crystals of this invention are produced by the controlled double-jet precipitation method. Preferably, monodisperse cubic crystal of the first silver halide is produced by the controlled double-jet precipitation method (FIG. 1), and then the second silver halide is precipitated by the controlled double-jet precipitation method including a stage of dissolution of the first silver halide crystals, giving monodisperse silver halide cubic crystals having depressions and hollows formed due to the dissolution of the first silver halide crystals (FIG. 2 and FIG. 3). However, the first silver halide crystals may not necessarily be produced by the controlled double-jet precipitation. As mentioned in Mees and James "The Theory of the Photographic Process", page 6 (1966), solubilities of silver iodide, silver bromide and silver chloride progressively increase by about 100 times. Therefore, the first and the second silver halides useful in this invention are preferably composed of mainly silver chloride and silver bromide, respectively. Typically, the first silver halide comprises mainly silver chloride and can contain up to 30 mol % of silver bromide and additionally up to several mol % of silver iodide, and the second silver halide comprises mainly silver bromide and can contain up to 30 mol % of silver chloride and additionally up to several mol % of silver iodide.

The novel silver halide crystals of this invention are produced by the controlled double-jet precipitation method by adding aqueous solutions of a halide and silver under the condition that the feed amount of the second silver halide per unit number of the first silver halide crystals is greater per unit time with keeping the condition of solubilities of the first and second silver halide.

That is, the distance l (μm) between the silver halide crystals in the first silver halide emulsion and addition rate Rp at controlled double-jet precipitation of the second silver halide must be specified as production conditions. The addition rate Rp is a quantity defined as mol number of halide ion or silver ion supplied in one hours per $10^{15}$ of the first silver halide crystals.

According to the preferred embodiment of the process of production of this invention, the controlled double-jet precipitation of the second silver halide is carried out under the condition that the value $l \times Rp$ is within the range of 2 to 20. When the value $l \times Rp$ is less than 2, the second silver halide is precipitated before the first silver halide is dissolved and hence the silver halide crystals having hollow portion of this invention are not formed. When the value is more than 20, the second silver halide crystals are independently formed. In both the cases, the useful photographic properties of this invention are not obtained.

According to further preferred embodiment of the process of production, temperature at the controlled double-jet precipitation of the second silver halide is 35° C.–70° C., pAg at the precipitation is 3–8 and pH at the precipitation is 4–8.

The preferred embodiment of the process of production according to this invention will be explained in more detail.

(a) The first monodisperse cubic silver halide emulsion is prepared by the known controlled double-jet precipitation method. That is, an aqueous solution of a water soluble silver salt and an aqueous solution of a water soluble alkali metal halide are added simultaneously to an aqueous solution of gelatin so that pAg becomes a certain constant value. Halogen ions in the aqueous solution of the water soluble alkali metal halide are predominantly chlorine ion, but can contain up to 30 mol % of bromine ion and up to several mol % of iodine ion.

(b) Concentration of the first silver halide emulsion is adjusted so that the distance l between the first silver halide crystals becomes a predetermined value. The distance l between silver halide crystals can be calculated from the size of silver halide crystal and mol number of the total silver halides contained in the emulsion.

(c) To the first silver halide emulsion (pH 4–8) having the adjusted distance l between silver halide crystals and kept at a temperature of 35° C.–70° C. with vigorous agitation are added simultaneously an aqueous solution of a water soluble silver salt and an aqueous solution of a water soluble alkali metal halide so that pAg becomes a certain value within the range of 3–8. The addition rate is such that the value $l \times Rp$ is within the range of 2–20. Halogen ions in the aqueous solution of water soluble alkali metal halide comprise predominantly bromine ion, but can contain up to 30 mol % of chlorine ion and up to several mol % of iodine ion.

(d) The emulsion obtained by the second controlled double-jet precipitation is precipitated and washed with water by a known method.

The silver halide crystals used in the silver halide photographic light-sensitive materials according to this invention are produced by the above-mentioned method.

The water soluble silver salt used for the controlled double-jet precipitation include silver nitrate, silver perchlorate, etc. and the water soluble alkali metal halides include sodium halide, potassium halide, etc. As protective colloids for silver halide, mention may be made of gelatin, gelatin derivatives, colloidal albumin, casein, cellulose derivatives such as carboxymethyl cellulose and hydroxyethyl cellulose, sugar derivatives such as agar, sodium alginate, and starch derivatives and synthetic hydrophilic colloids such as polyvinyl alcohol, poly-N-vinyl pyrrolidone, polyacrylic acid copolymer, polyacrylamide and derivatives thereof. If necessary, compatible mixtures of two or more of these colloids, for example, copolymers of acrylamide, acrylic acid and methylvinylimidazole may be used.

The novel silver halide photographic emulsions of this invention may be doped with various metal salts or metal complexes during or after growth of crystals. There may be used, for example, metal salts or complexes of gold, platinum, palladium, iridium, rhodium, bismuth, cadmium, copper, lead, etc. and combinations thereof.

Furthermore, the emulsions of this invention may be subjected to various chemical sensitizations applied to general emulsions. That is, the chemical sensitizations may be accomplished with one or more of chemical sensitizers such as active gelatin, noble metal sensitizers, e.g., water soluble gold salts, water soluble platinum salts, water soluble palladium salts, water soluble rhodium salts, water soluble iridium salts, etc., sulfur sensitizers, selenium sensitizers, reduction sensitizers, e.g., polyamides, stannous chloride, etc.

The silver halide emulsions of this invention are prepared by spectral sensitization with addition of sensitizing dyes.

That is, spectral sensitizing dyes having maximal of absorption in blue, green and red regions of visible wavelength range are used and for specific purposes, spectral sensitizing dyes which extend the sensitive wavelength region beyond the visible wavelength region are used. That is, infrared absorption spectral sensitizers are used.

The silver halide emulsion of this invention can be spectral sensitized with various dyes including polymethine dyes such as cyanine, merocyanine and complex cyanine and merocyanine (i.e., tri-, tetra-, and polynuclear cyanine and merocyanine), oxonol, hexyoxonol, styryl cyanine, merostyryl cyanine and strept cyanine.

The cyanine spectral sensitizing dyes contain two basic heterocyclic rings linked by methine bridge, for example, nuclei derived from quinolinium, pyridinium, isoquinolinium, 3H-indolium, benzo[e]indolium, oxazolium, oxazolinium, thiazolium, thiazolinium, selenazolium, selenazolinium, imidazolium, imidazolinium, benzoxazolium, benzothiazolium, benzoselenazolium, benzoimidazolium, naphthoxazolium, naphthothiazolium, naphthoselenazolium, dihydronaphthothiazolium, pyrylium and imidazopyrazinium quaternary salt.

The merocyanine spectral sensitizing dyes contain cyanine dye type basic heterocyclic nuclei or acidic nuclei linked directly or through interposition by methine bridge, for example, nuclei derived from barbituric acid, 2-thiobarbituric acid, rhodanine, hydantoin, 2-thiohydantoin, 4-thiohydantoin, 2-pyrazoline-5-one, 2-isooxazoline-5-one, indane-1,3-dione, cyclohexane-1,3-dione, 1,3-dixane-4,6-dione, pyrazoline-3,5-dione, pentane-2,4-dione, alkylsulfonylacetonitrile, malononitrile, isoquinoline-4-one, and chroman-2,4-dione.

Cyanine and related dyes are explained in Weissberger and Taylor, "Special Topics of Heterocyclic Chemistry", John Wiley and Sons, New York, 1977, Chapter VIII: Venkataraman, "The Chemistry of Synthetic Dyes", Academic Press, New York, 1971, Chapter V: James, "The Theory of the Photographic Process", the 4th edition, Macmillan, 1977, Chapter 8 and F. M. Hamer, "Cyanine Dyes and Related Compounds", John Wiley and Sons, 1964.

One or more of spectral senstizing dyes may be used in combination. Dyes having sensitization maximum in the whole visible wavelength region and having various shapes of spectral sensitivity curves are known. Selection and addition ratio of dyes are determined depending on sensitivity in sensitive wavelength region and the shape of spectral sensitivity curve. Use of dyes in combination which have overlapping spectral sensitivity curves mostly show curves in which the sensitivity in the overlapping region is nearly equal to the simple additive of the sensitivities of the respective dyes.

However, for some sensitizing dyes, it is possible to combine them to afford spectral sensitization greater than the simple additive of sensitivities of respective dyes and this is known as supersensitization. This super sensitization may also be attained by selected combination of a spectral sensitizing dye with other additives such as stabilizer, antifoggant, development accelerator or retardant, coating assistant, fluorescent brightener and antistatic agent. The super sensitization is explained in detail in Gilman, "Review of the Mechanism of Supersensitization", Photographic Science and Enginnering, Vol. 18, 1974, pages 418–430.

Spectral sensitizing dyes may affect emulsions in other ways. As disclosed in U.S. Pat. Nos. 2,131,038 and 3,930,860, spectral sensitizing dyes may act as antifoggants, stabilizers, development accelerators or retardants and halogen acceptors or electron acceptrors.

In one preferred embodiment of this invention, silver halide emulsions used in this invention can contain spectral sensitizing dyes which are adsorbed to the surface of silver halide crystals to change hues. That is, in practicing of this invention may be used any ordinary spectral sensitizing dyes which afford increase of light absorption in longer wavelength side and shorter wavelength side by adsorption to the surface of silver halide crystals. These dyes which meet said standard are well known in the arts and explained, for example, in T. H. James "The Theory of the Photographic Process", 4th edition, Macmillan, 1977, Chapters 8 and 9 and F. M Hamer, "Cyanine Dyes and Related Compounds", John Wiley and Sons, 1964, Vol. XVII. Merocyanine, hemicyanine, styryl and oxonol spectral sensitizing dyes which form H-aggregate (displacement to shorter wavelengths) are known in the arts, but J-aggregate (displacement to longer wavelengths) is usually not formed by these dyes. Preferred spectral sensiizing dyes are cyanine dyes which show H- or J-aggregation.

In further preferable embodiment, the spectral sensitizing dyes are carbocyanine dyes which J-aggregate. Such dyes are characterized by having two or more basic heterocyclic nuclei linked through three methine groups. The heterocyclic nuclei preferably contains condensed benzene ring to accelerate J-aggregation. Heterocyclic nuclei preferred for acceleration of J-aggregation are quinolinium, benzoxazolium, benzothiazolium, benzoselenazolium, benzimidazolium, naphthoxazolium, naphthothiazolium and naphthoselenazolium quaternary salts.

Silver halide photographic light-sensitive materials for recording blue light usually rely on the inherent sensitivity of silver halide crystals, but even if the principal absorption is in the wavelength region of the inherent sensitivity, use of spectral sensitizer can give remarkable effects.

Preferable blue spectral sensitizing dyes include polymethine dyes such as cyanine, merocyanine, hemicyanine, hemioxonol and merostyryl. Generally, useful blue spectral sensitizing dyes can be chosen from the group of these dyes depending on absorption characteristics, namely, hue. However, there are structural corelations which can be guides for choice of useful blue sensitizers. Generally, the maximum wavelength of senstization becomes shorter with shorter methine chain. The nuclei also affect the absorption. Absorption wavelength is liable to become longer with addition of condensed rings to the nuclei. Substituents also have an effect on absorption characteristics.

As spectral sensitizing dyes useful for sensitization of silver halide emulsions, mention may be made of those which are disclosed in "Research Disclosure", Vol. 176, December, 1978, Item 17643, Section III.

The dyes can be used in an ordinary amount for spectral sensitization of silver halide emulsion according to this invention. Amount of dyes used varies depending on the specific dye or the combination of the dyes chosen and size of silver halide crystals. In case of organic dyes, optimum spectral sensitization can be obtained by coverage of about 25–100% or more of the total available surface of silver halide crystals by a layer of dye one molecule thick. This is well known in photographic industry. (See, for example, West et al., "The Adsorption of Sensitizing Dyes in Photographic Emulsions", Journal of Phys. Chem., Vol. 56, pages 1065, 1952; Spence et al., "Desensitization of Sensitizing Dyes", Journal of Physical and Colloid Chemistry, Vol. 56, No. 6, June, 1948, pages 1090–1103; and U.S. Pat. No. 3,979,213.). The optimum dye concentration level can be determined by the method described in Mees, "Theory of the Photographic Process", 1942, Macmillan, pages 1067–1069.

Spectral sensitization may be carried out at any stages of emulsion preparation conventionally known to be effective. Most commonly, spectral sensitization is effected after completion of chemical sensitization. However, it is disclosed in U.S. Pat. Nos. 3,628,960 and 4,225,666 that spectral sensitization may be effected simultaneously with chemical sensitization or before chemical sensitization or even before completion of precipitation of silver halide emulsion. As disclosed in U.S. Pat. No. 4,225,666 it is also possible to dividedly introduce a spectral sensitizing dye into emulsion in such a manner that a part of the dye is present in the emulsion before chemical sensitization and the remainder is introduced after chemical sensitization. It is reported in "Research Disclosure", Vol. 131, May, 1979, Item 18155 that sensitization can be enhanced by cyclically adjusting pAg during chemical and/or spectral sensitization.

In still further preferred embodiment of this invention, spectral sensitizer can be introduced before chemical sensitization into the silver halide emulsion used in silver halide photographic light-sensitive materials of this invention. In some case the similar result can be attained by introducing other adsorbable materials such as various additives into emulsion before chemical sensitization.

Silver halide emulsions used in the silver halide photographic light-sensitive materials of this invention can contain commonly used various additives depending on purpose. Examples of these additives are stabilizers or antifoggants such as azaindenes, triazoles, tetrazoles, imidazolium salts, tetrazolium salts, polyhydroxy compounds, etc.; hardners such as aldehydes, aziridines, inoxazoles, vinylsulfones, acryloyls, arpodiimides, maleimides, methanesulfonic acid esters, triazines, etc.; development acclerators such as benzyl alcohol, polyoxyethylenes, etc.; image stabilizers such as chromans, chramans, bisphenols, phosphorous acid esters; and lubricants such as waxes, glycerides of higher fatty acids, higher alcohol esters of higher fatty acids, etc.

Furthermore, anionic, cationic, non-ionic or amphoteric compounds may be used as surface active agents, improving agents of permeability of processing solution or deformers or light-sensitive materials. As the antistatic agents, diacetyl cellulose, styrene-perfluoroalkyl lithium maleate copolymer, alkali salts of reaction products of styrene- maleic anhydride copolymer and p-aminobenzenesulfonic acid, etc. are effective. As matting agents there may be used polymethyl methacrylate, polystyrene, alkali soluble polymers, etc. Colloidal silicon oxide may also be used. As latexes added for improving film properties there may be used copolymers of acrylic acid esters, vinyl esters, etc. with other monomers having ethylene group. Glycerin, glycol compounds, etc. may be used as gelatin plasticizers. Styrene-sodium maleate copolymer, alkyl vinyl ether-maleic acid copolymer, etc. may be used as thickening agents.

Supports for the silver halide photographic light-sensitive materials of this invention include, for example, baryta paper, polyethylene coated paper, polypropylene synthetic paper, glass paper, cellulose acetate film, cellulose nitrate film, polyvinyl acetal film, polypropylene film, polyester films such as polyethylene terephthalate, polystyrene film, etc. These supports may be optionally chosen depending on the use of silver halide photographic light-sensitive materials. These supports may be subjected to subbing treatment, if necessary.

The silver halide photographic light-sensitive materials may be used as light-sensitive materials for various uses such as for general monochrome, X-ray, color, infrared, microphotograph, silver-dye-bleach process, reversal, diffusion transfer photographs.

The silver halide photographic light-sensitive materials of this invention are preferably used as color light-sensitive materials and for this purpose, means and materials usually employed for color light-sensitive materials may be applied, for example, cyan, magenta and yellow couplers are incorporated in combination into the emulsions of this invention which are rendered red, green and blue sensitive.

The silver halide photographic light-sensitive materials of this invention after exposure may be developed by commonly employed known method.

Black and White developing solution is an alkali solution containing a developing agent such as hydroxybenzenes, aminophenols, aminobenzenes, etc. and may also contain sulfites, carbonates, bisulfites, bromides and iodides of alkali metals.

Color light-sensitive materials can be color developed by the ordinary color developing method. In case of reversal method, the materials are first developed with a black and white developer for negative and then exposed with white light or are treated with a bath containing a fogging agent and further developed with an alkali developer containing a color developing agent. There is no specific limitation in subsequent treatments and any treatments may be applied. Representatives thereof are, for example, bleaching and fixing treatments after color development and if necessary, additional washing with water and stabilization treatments or separate bleaching treatment and fixing treatment after color development and if necessary washing with water and stabilization treatment. Furthermore, it is also known to treat light-sensitive materials of low silver halide content with an amplifier such as hydrogen peroxide cobalt complex salt. These treatments may be carried out at high temperatures in order to accomplish them rapidly or may be carried out at room temperature or lower in a special case. Pre-hardening treatment may also be effected when rapid treatment at high temperatures is carried out.

REFERENTIAL EXAMPLE

A first controlled double-jet precipitation was effected using the following three solutions to prepare monodisperse cubic silver chloride emulsions.

[Solution A]

| | |
|---|---|
| Ossein gelatin | 20 gr |

-continued

| | |
|---|---|
| Distilled water to make up | 400 ml |
| [Solution B] | |
| Silver nitrate | 122.4 gr |
| Distilled water to make up | 240 ml |
| [Solution C] | |
| NaCl | 42.1 gr |
| Distilled water to make up | 240 ml |

Solution B and solution C were added to solution A kept at 60° C. with stirring over a period of 60 minutes by the controlled double-jet precipitation method. During the addition, pAg of solution A was kept at 6.5 by measurement of silver potential and flow control of solution C. Finally obtained emulsion was of monodisperse cubic silver chloride crystal grains which are shown in electron micrograph of FIG. 1. This emulsion was called EM-1.

EXAMPLE 1

EM-1 was diluted with an aqueous gelatin solution to obtain a seed emulsion having distance l between silver halide crystals of 1.39 μm and a gelatin concentration of 3%.

Second controlled double-jet precipitation was effected using the following three solutions.

| | |
|---|---|
| [Solution A] | |
| Seed emulsion (l = 1.39 μm, pH = 6) | 400 ml |
| [Solution B] | |
| Silver nitrate | 7.9 gr |
| Distilled water to make up | 46.5 ml |
| [Solution C] | |
| KBr | 5.5 gr |
| Distilled water to make up | 46.5 ml |

According to the controlled double-jet precipitation method, solution B and solution C were added to solution A kept at 50° C. with stirring at a rate of 2 ml/min over a period of 23 minutes. In this case, the mol number Rp of silver ion or bromine ion supplied per $10^{15}$ of seed crystals for one hour was 2.26. Therefore, the value 1×Rp was 3.14. During the addition the pAg of solution A was kept at 5.5. The finally obtained emulsion was of monodisperse cubic crystal grains having an average edge length of 0.34 μm and having depressions and/or hollow portions as shown in electron micrograph of FIG. 2. This emulsion was called EM-2.

EXAMPLE 2

EM-1 was diluted with an aqueous gelatin solution to obtain a seed emulsion having a distance l between silver halide crystals of 1.63 μm and a gelatin concentration of 3%.

Second balanced double-jet precipitation was carried out using the following three solutions.

| | |
|---|---|
| [Solution A] | |
| Seed emulsion (l = 1.63 μm, pH 5) | 140 ml |
| [Solution B] | |
| Silver nitrate | 1.8 gr |
| Distilled water to make up | 10.8 ml |

-continued

| | |
|---|---|
| [Solution C] | |
| KBr | 1.3 gr |
| Distilled water to make up | 10.8 ml |

By the controlled double-jet precipitation method, solution B and solution C were added to solution A kept at 45° C. with stirring at a rate of 2 ml/min over a period of 5.5 minutes. In this case the value Rp was 9.68 and so the value 1×Rp was 15.78. During the additon, pAg of solution A was kept at 6.0. The finally obtained emulsion was of monodisperse cubic crystal grains having an average edge length of 0.34 μm and having depressions and hollow portions as shown in the electron micrograph of FIG. 3. This emulsion was called EM-3.

EXAMPLE 3

EM-1 was diluted with an aqueous gelatin solution to obtain a seed emulsion having a distance l between silver halide crystals of 0.83 μm and a gelatin concentration of 3%.

Second controlled double-jet precipitation was effected using the following three solutions.

| | |
|---|---|
| [Solution A] | |
| Seed emulsion (l = 0.83 μm, pH 6) | 200 ml |
| [Solution B] | |
| Silver nitrate | 13.1 gr |
| Distilled water to make up | 77.2 ml |
| [Solution C] | |
| KBr | 9.2 gr |
| Distilled water to make up | 77.2 ml |

By the controlled double-jet precipitation method, solution B and solution C were added to solution A kept at 50° C. with stirring at a rate of 2 ml/min over a period of 38.5 minutes. In this case the value Rp was 1.36 and so the value 1×Rp was 1.13. During the addition, pAg of solution A was kept at 5.5. The finally obtained emulsion was of core-shell type cubic crystals having an average edge length of 0.32 μm and free from hollow portions according to observation under an electron microscope. The resulting emulsion was called EM-4.

EXAMPLE 4

As a comparative emulsion for examination of chemical sensitizability of the emulsions of this invention was prepared a cubic silver bromide emulsion having an average edge length of 0.33 μm by the same method as of the Referential Example. This emulsion was called EM-5.

EM-2, EM-3, EM-4 and EM-5 obtained above were subjected to precipitation and washing with water in accordance with the conventional method and equal portions of these emulsions were sensitized with sodium chloroaurate and sodium thiosulfate by the conventional method at pH 5 and pAg 7.3 and at 50° C. for a time sufficient to attain the maximum sensitivity. These emulsions of same amount were coated on film supports. When these samples were tested under the same exposure and development conditions, the emulsions EM-2 and EM-3 of this invention exhibited the sensitivity more than 2 times that of the comparative emulsions EM-4 and EM-5.

EXAMPLE 5

The emulsions EM-2 and EM-5 chemically sensitized in Example 4 were subjected to spectral sensitization by adding various sensitizing dyes having the following structural formulas and were called EM-6 and EM-7, respectively.

(1)

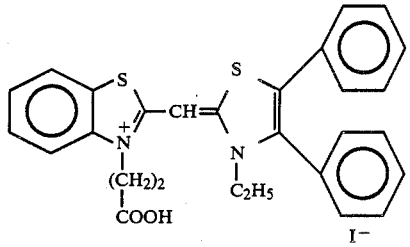

(2)

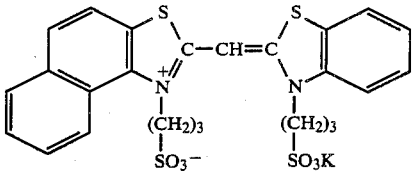

(3)

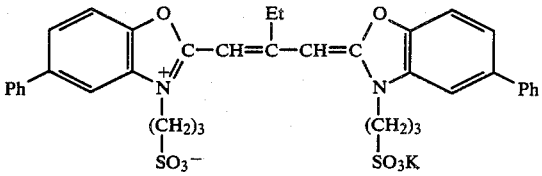

(4)

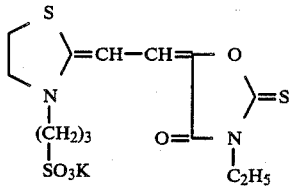

(5)

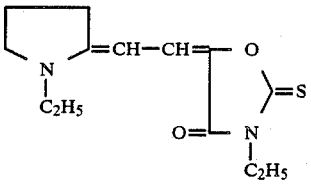

(6)

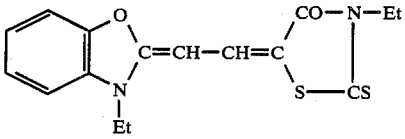

The emulsions which were subjected to the optimum spectral sensitization were respectively coated in the same amount on film supports and then these samples were subjected to sensitometry under the same exposure and development conditions. The results are shown in Table 1. The spectral sensitization efficiency shown in Table 1 was defined as the quotient of the sensitivity of the emulsion subjected to both the chemical sensitization and spectral sensitization which is divided by the sensitivity of the emulsion subjected to only chemical sensitization. The sensitivity was obtained from the exposure required for providing the optical density of "fog+0.1".

As is seen in Table 1, the silver halide photographic light-sensitive materials of this invention are markedly high in spectral sensitization efficiency.

Thus, the photographic light-sensitive materials of this invention are very excellent as high speed light-sensitive materials.

TABLE 1

| | EM-6 (This invention) | | EM-7 (Comparative) | |
|---|---|---|---|---|
| Dyes | Spectral sensitization efficiency | Fog | Spectral sensitization efficiency | Fog |
| (1) | 2.3 | 0.04 | 1.7 | 0.03 |
| (2) | 2.8 | 0.03 | 1.3 | 0.04 |
| (3) | 16.7 | 0.04 | 13.9 | 0.03 |
| (4) | 2.4 | 0.05 | 1.7 | 0.05 |
| (5) | 5.3 | 0.03 | 1.3 | 0.04 |
| (6) | 2.4 | 0.05 | 1.7 | 0.05 |

What is claimed is:

1. Silver halide crystals which are cubic type crystals and which have a depression on each face thereof and/or a hollow portion formed by joining of the depression with other depressions.

2. A method for producing monodisperse cubic type silver halide crystals having a depression on each face thereof and/or a hollow portion formed by joining of the depressions which comprises precipitating first monodisperse cubic type silver halide crystals and then precipitating second silver halide having a lower solubility than the first silver haiide crystals by controlled double-jet precipitation method to dissolve the first silver halide crystals.

3. A method according to claim 2 wherein the precipitation of the first monodisperse cubic type silver halide crystals is carried out by controlled double-jet precipitation method.

4. A method according to claim 2 wherein the first silver halide is mainly composed of silver chloride and the second silver halide is mainly composed of silver bromide.

5. A method according to claim 2 wherein the precipitation of the second silver halide is carried out at a temperature of 35° C.–70° C., at a pAg of 3–8 and at a pH of 4–8.

6. A silver halide photographic emulsion which contains silver halide crystals which are cubic type crystals and which have a depression on each face and/or a hollow portion and a spectral sensitizing dye adsorbed to the surface of said silver halide crystals.

7. A method for producing a silver halide photographic emulsion which contains silver halide crystals which are cubic type crystals and have a depression on each face and/or a hollow portion which includes the steps of precipitating in a first monodisperse cubic type silver halide emulsion a second silver halide by controlled double-jet precipitating method and of spectral sensitization.

8. A method according to claim 7 wherein precipitation of the second silver halide is carried out by adding to the first silver halide emulsion having the distance l adjusted to a predetermined length simultaneously an aqueous solution of a water soluble silver salt and an aqueous solution of a water soluble alkali metal halide under the condition that the value $l \times Rp$ is 2–20.

9. A silver halide photographic light-sensitive material which comprises a support and at least one silver halide emulsion layer provided thereon which contains silver halide crystals which have a depression on each face and/or a hollow portion and a spectral sensitizing dye adsorbed to the surface of said silver halide crystals.

10. A silver halide photographic light-sensitive material according to claim 9 wherein the spectral sensitizing dye is a cyanine or merocyanine dye.

11. Silver halide cubic crystals having a depression on each face thereof and/or a hollow portion formed by joining of the depression with other depressions which are produced by precipitating first monodisperse cubic type silver halide crystals and then precipitating second silver halide having a lower solubility than the first silver halide crystals by controlled double-jet precipitation method to dissolve the first silver halide crystals.

12. A method for producing monodisperse cubic type silver halide crystals having a depression on each face thereof and/or a hollow portion formed by joining of the depressions which comprises precipitating first monodisperse cubic type silver halide crystals and then precipitating second silver halide having a lower solubility than the first silver halide crystals by controlled double-jet precipitation method to dissolve the first silver halide crystals, said precipitation of the second silver halide being carried out under the condition that the value $l \times Rp$ is 2–20 where l means the distance ($\mu$m) between the first silver halide crystals and Rp means a mol number of halide ion or silver ion of the second silver halide supplied per $10^{15}$ of the first silver halide crystals for one hour.

13. A method according to claim 12 wherein the first silver halide is mainly composed to silver chloride and the second silver halide is mainly composed of silver bromide.

14. A method according to claim 12 wherein the precipitation of the second silver halide is carried out at a temperature of 35° C.–70° C., at a pAg of 3–8 and a pH of 4–8.

* * * * *